US010335694B2

(12) United States Patent
Koide et al.

(10) Patent No.: US 10,335,694 B2
(45) Date of Patent: Jul. 2, 2019

(54) METHOD AND APPARATUS FOR FASTENING OF INFLATABLE RIDE SURFACES

(71) Applicant: Whitewater West Industries Ltd., Richmond (CA)

(72) Inventors: Brad Koide, San Diego, CA (US); Marshall Corey Myrman, San Diego, CA (US)

(73) Assignee: Whitewater West Industries LTD., Richmond (CA)

( * ) Notice: Subject to any disclaimer, the term of this patent is extended or adjusted under 35 U.S.C. 154(b) by 0 days.

(21) Appl. No.: 15/350,833

(22) Filed: Nov. 14, 2016

(65) Prior Publication Data

US 2017/0136372 A1 May 18, 2017

Related U.S. Application Data

(60) Provisional application No. 62/254,631, filed on Nov. 12, 2015.

(51) Int. Cl.
*A63G 21/18* (2006.01)
*A63G 31/00* (2006.01)
(Continued)

(52) U.S. Cl.
CPC ..... *A63G 31/007* (2013.01); *A63B 69/0093* (2013.01); *A63B 2209/10* (2013.01)

(58) Field of Classification Search
CPC ..... A63G 31/00; A63G 31/007; A63G 21/00; A63G 21/18; A63B 67/007; E04F 15/00;
(Continued)

(56) References Cited

U.S. PATENT DOCUMENTS

X490484 1/1893 Mackaye
X586718 7/1897 Wharton, Jr.
(Continued)

FOREIGN PATENT DOCUMENTS

AU 668713 5/1996
AU 703850 10/1996
(Continued)

OTHER PUBLICATIONS

ISR and Written Opinion for PCT/US2014/031322, dated Aug. 20, 2014. 2014.

*Primary Examiner* — Kien T Nguyen
(74) *Attorney, Agent, or Firm* — Buchalter, a professional corp; Kari L. Barnes

(57) ABSTRACT

A system, apparatus, and method for constructing or providing a ride surface for an amusement attraction, such as an inflatable surfing attraction. The ride surface may be formed via the connection of a plurality of ride surface portions or segments. The ride surface may be connected via fastening elements that are disposed at an elevation different from that of the top or other surface that is to be used by riders during operation. Cut-outs and/or extrusions within one or more of the ride surface portions or segments may aid in preventing disruptive forces from fluid or water during operation from acting to separate the ride surface portions of segments making up the ride surface. Additional fastening mechanisms may be employed in addition to such fastening elements to further aid in increasing durability.

18 Claims, 5 Drawing Sheets

(51) Int. Cl.
*A63B 69/00* (2006.01)
*E04F 15/02* (2006.01)

(58) Field of Classification Search
CPC ..... E04F 15/02; E04F 2201/0115; E04F 2201/0146; E04F 15/02038
USPC ..... 472/13, 116, 117, 128, 88–91; 52/589.1, 52/590.1, 590.2
See application file for complete search history.

(56) References Cited

U.S. PATENT DOCUMENTS

X586983 7/1897 Wharton, Jr.
X799708 9/1905 Boyce
1,392,533 A 10/1921 Smyth
1,536,875 A 5/1925 Bowen
1,655,498 A 1/1928 Fisch
1,701,842 A 2/1928 Fisch
1,871,215 A 8/1932 Keller
1,884,075 A 10/1932 Meyers
2,117,982 A 5/1938 Prince, Jr.
2,558,759 A 7/1951 Johnson
3,005,207 A 10/1961 Matrai
3,038,760 A 6/1962 Crooke
3,085,404 A 4/1963 Smith
3,120,385 A 2/1964 Hall
3,216,455 A 11/1965 Cornell
3,363,583 A * 1/1968 Greenberg ..... B61B 11/00 104/134
3,473,334 A 10/1969 Dexter
3,477,233 A 11/1969 Andersen
3,478,444 A 11/1969 Presnell
3,497,211 A 2/1970 Nagin
3,547,749 A 12/1970 White
3,557,559 A 1/1971 Barr
3,562,823 A 2/1971 Koster
3,565,491 A 2/1971 Fraizer
3,598,402 A 6/1971 Frenzl
3,611,727 A 10/1971 Blandford
3,613,377 A 10/1971 Zaugg
3,757,370 A 9/1973 Seno
3,789,612 A 2/1974 Richard
3,802,697 A 4/1974 Le Mehaute
3,845,510 A 11/1974 Baker
3,850,373 A 11/1974 Grolitsch
3,851,476 A 12/1974 Edwards
3,853,067 A 12/1974 Bacon
3,913,332 A 10/1975 Forsman
2,815,951 A 12/1975 Baldanza
3,981,612 A 9/1976 Bunger
4,062,192 A 12/1977 Biewer
4,087,088 A 5/1978 Kelso
4,122,560 A 10/1978 Baker
4,147,844 A 4/1979 Babinky
4,149,710 A 4/1979 Rouchard
4,196,900 A 4/1980 Becker
4,197,815 A 4/1980 Brazelton
4,198,043 A 4/1980 Timbes
4,201,496 A 5/1980 Andersen
4,244,768 A 1/1981 Wiechowski et al.
4,246,980 A 1/1981 Miller
4,276,664 A 7/1981 Baker
4,278,247 A 7/1981 Joppe
4,339,122 A 7/1982 Croul
4,374,169 A 2/1983 Gryskiewicz et al.
4,429,867 A 2/1984 Barber
4,474,369 A 10/1984 Gordon
4,522,535 A 6/1985 Bastenhof
4,539,719 A 9/1985 Schuster
4,557,475 A 12/1985 Donovan
4,561,133 A 12/1985 Laing
4,564,190 A 1/1986 Frenzyl
4,574,107 A 3/1986 Ferrari
4,662,781 A 5/1987 Tinkler
4,707,869 A 11/1987 Ray
4,736,912 A 4/1988 Loebert
4,790,155 A 12/1988 Daniei
4,792,260 A 12/1988 Sauerbier
4,970,685 A 12/1988 Scott
4,805,897 A 2/1989 Dubeta
4,806,048 A 2/1989 Ito
4,836,521 A 6/1989 Barber
4,903,959 A 2/1990 Barber
4,905,987 A 3/1990 Frenzl
4,954,014 A 9/1990 Sauerbier
4,976,422 A 12/1990 Shimamura
4,988,364 A 1/1991 Perusich et al.
5,020,465 A 6/1991 Langford
5,061,211 A 10/1991 Barber
5,125,577 A 6/1992 Frankel
5,170,901 A 12/1992 Bersani
5,171,101 A 12/1992 Sauerbier
5,183,438 A 2/1993 Biom
5,213,547 A 5/1993 Lochtefeld
5,219,315 A 6/1993 Fuller
5,236,280 A 8/1993 Lochtefeld
5,236,404 A 8/1993 Maclennan
RE34,407 E 10/1993 Frenszl
5,267,812 A 12/1993 Suzuki
5,271,692 A 12/1993 Lochtefeld
5,288,536 A 2/1994 Long
5,314,383 A 5/1994 Fabbi
5,342,145 A 8/1994 Cohen
5,370,591 A 12/1994 Jewell
5,378,197 A 1/1995 Briggs
5,384,019 A 1/1995 Keating
5,385,518 A 1/1995 Turner
5,387,159 A 2/1995 Hilgert
5,393,170 A 2/1995 Lochtefeld
5,401,117 A 3/1995 Lochtefeld
5,421,782 A 6/1995 Lochtefeld
5,427,574 A 6/1995 Donnelly-Weide
5,453,054 A 9/1995 Lochtefeld
5,503,597 A 4/1996 Lochtefeld
5,524,310 A 6/1996 Farnen
5,540,662 A 7/1996 Gold
5,564,859 A 10/1996 Lochtefeld
5,621,925 A 4/1997 Bastenhof
5,628,584 A 5/1997 Lochtefeld
5,638,556 A 6/1997 Kipers
5,667,445 A 9/1997 Lochtefeld
5,676,601 A 10/1997 Saunders
5,738,590 A 4/1998 Lochtefeld
5,779,553 A 7/1998 Langford
5,827,608 A 10/1998 Rinehart et al.
5,899,633 A 5/1999 Lochtefeld
5,899,634 A 5/1999 Lochtefeld
5,937,586 A 8/1999 Scherba
6,019,547 A 2/2000 Hill
6,112,469 A 9/2000 Zweig
61,322,317 10/2000 Lochtefeld
6,312,341 B1 11/2001 Healy
6,319,137 B1 11/2001 Lochtefeld
6,336,771 B1 1/2002 Hill
6,345,791 B1 2/2002 McClure
6,363,677 B1 * 4/2002 Chen ..... E04F 15/02 52/384
6,375,578 B1 4/2002 Briggs
6,491,589 B1 12/2002 Lochtefeld
6,527,646 B1 3/2003 Briggs
6,616,542 B1 9/2003 Reddick
6,676,530 B2 1/2004 Lochtefeld
6,716,107 B2 4/2004 Lochtefeld
6,726,403 B1 4/2004 Kriticos
6,758,231 B1 7/2004 Lochtefeld
6,796,096 B1 9/2004 Heath
6,920,651 B2 7/2005 Roberts
7,547,255 B2 6/2009 Lochtefeld
7,607,271 B2 * 10/2009 Griffin ..... E04C 2/296 52/478
7,666,104 B2 2/2010 Lochtefeld
7,717,645 B2 5/2010 McLaughlin
7,775,895 B2 6/2010 Henry
7,789,804 B1 9/2010 Phillips

(56) References Cited

U.S. PATENT DOCUMENTS

| | | | | |
|---|---|---|---|---|
| 7,951,011 | B2 | 5/2011 | Lochtefeld | |
| 8,042,200 | B2 | 10/2011 | Webber | |
| 8,056,295 | B2 * | 11/2011 | Cappelle | B44C 1/26 52/581 |
| 8,088,016 | B2 | 1/2012 | Murphy | |
| 8,550,926 | B2 | 10/2013 | Lochtefeld | |
| 8,641,532 | B2 | 2/2014 | Lochtefeld | |
| 8,784,224 | B1 | 7/2014 | Schafer | |
| 8,882,604 | B2 | 11/2014 | Lochtefeld | |
| 9,072,927 | B2 | 7/2015 | Sammann | |
| 9,194,146 | B2 | 11/2015 | Murphy | |
| 9,254,428 | B2 | 2/2016 | Kriticos | |
| 9,463,390 | B2 | 10/2016 | Vicente | |
| 9,550,127 | B2 | 1/2017 | Lochtefeld | |
| 9,878,255 | B2 | 1/2018 | Kriticos | |
| 2003/0004003 | A1 | 1/2003 | Lochtefeld | |
| 2003/0029109 | A1 * | 2/2003 | Hellberg | B27B 1/00 52/311.1 |
| 2003/0153221 | A1 | 8/2003 | Weir | |
| 2003/0154681 | A1 * | 8/2003 | Pletzer | E04F 15/04 52/578 |
| 2004/0216226 | A1 | 11/2004 | Demarateau | |
| 2004/0244636 | A1 | 12/2004 | Meadow | |
| 2004/0245780 | A1 | 12/2004 | Roberts | |
| 2005/0148398 | A1 | 7/2005 | Lochtefeld | |
| 2006/0009343 | A1 | 5/2006 | Unterweger | |
| 2006/0093435 | A1 | 5/2006 | Unterweger | |
| 2007/0167246 | A1 | 7/2007 | McKee | |
| 2008/0044621 | A1 | 2/2008 | Strauss | |
| 2008/0216427 | A1 | 9/2008 | Lochtefeld | |
| 2008/0262666 | A1 | 10/2008 | Manning | |
| 2008/0286048 | A1 | 11/2008 | Camahan | |
| 2008/0293505 | A1 | 11/2008 | Northam | |
| 2009/0029785 | A1 | 1/2009 | McKee | |
| 2009/0137330 | A1 | 5/2009 | Sefchick | |
| 2009/0169305 | A1 | 7/2009 | Lochtefeld | |
| 2011/0045916 | A1 | 2/2011 | Casimaty | |
| 2011/0314589 | A1 | 12/2011 | Vito et al. | |
| 2012/0037198 | A1 | 2/2012 | Cantin | |
| 2013/0074254 | A1 | 3/2013 | Payne et al. | |
| 2013/0130815 | A1 * | 5/2013 | Lochtefeld | A63B 69/0093 472/128 |
| 2013/0130615 | A1 | 7/2013 | Lochtefeld | |
| 2013/0281221 | A1 | 10/2013 | Bowen | |
| 2014/0357387 | A1 | 12/2014 | Murphy | |
| 2015/0057093 | A1 | 2/2015 | Murphy | |
| 2015/0065261 | A1 | 3/2015 | Lochtefeld | |
| 2015/0119155 | A1 | 4/2015 | Vicente | |
| 2015/0273353 | A1 | 10/2015 | Coleman | |
| 2016/0076267 | A1 | 3/2016 | Murphy | |
| 2016/0354700 | A1 | 12/2016 | Vicente | |
| 2017/0136368 | A1 | 5/2017 | Koide | |
| 2017/0136371 | A1 | 5/2017 | Vicente | |
| 2017/0136372 | A1 | 5/2017 | Koide | |
| 2017/0136373 | A1 | 5/2017 | Vicente | |

FOREIGN PATENT DOCUMENTS

| | | | |
|---|---|---|---|
| AU | 774900 | | 7/2004 |
| AU | 2002307400 | | 3/2007 |
| AU | 2007201135 | | 4/2007 |
| AU | 2008321385 | | 5/2009 |
| AU | 2009202257 | | 7/2009 |
| AU | 2011349052 | | 12/2011 |
| BR | PI0721429-4 | | 3/2014 |
| CA | 2090878 | | 3/1992 |
| CA | 2444510 | | 10/2002 |
| CA | 2680562 | | 4/2009 |
| CA | 2705677 | | 5/2009 |
| CA | 2824789 | | 12/2011 |
| CA | 02856807 | | 5/2013 |
| CA | PCT/CA14/00644 | | 8/2014 |
| CA | 2852868 | | 11/2014 |
| CA | 2869343 | | 4/2015 |
| CA | 2922576 | | 2/2016 |
| CH | 176562 | | 4/1935 |
| CN | 101965147 | | 10/2002 |
| CN | 1377291 | A | 2/2011 |
| CN | 10411244 | A | 10/2014 |
| DE | 159793 | | 8/1903 |
| DE | 271412 | | 11/1912 |
| DE | 373684 | | 4/1932 |
| DE | 1210155 | | 2/1966 |
| DE | 2222594 | | 11/1973 |
| DE | 2714223 | | 10/1978 |
| DE | 96216 | | 2/1983 |
| DE | 3445976 | | 12/1984 |
| DE | 69114013 | | 4/2002 |
| EP | 0096216 | | 12/1983 |
| EP | 0298853 | | 1/1989 |
| EP | 0547117 | | 10/1995 |
| EP | 0629139 | | 5/1997 |
| EP | 02762145.7 | | 11/2003 |
| EP | 1381435 | | 9/2012 |
| EP | 2219504 | | 2/2013 |
| ES | 2219504 | | 2/2001 |
| FR | 1019527 | | 1/1953 |
| FR | 1300144 | | 8/1962 |
| FR | 1539959 | | 9/1968 |
| FR | 2671977 | | 7/1992 |
| GB | 375684 | | 6/1932 |
| GB | 1090262 | | 11/1967 |
| GB | 1118083 | | 6/1968 |
| GB | 1159269 | | 7/1969 |
| GB | 1204629 | | 9/1970 |
| GB | 1210155 | | 10/1970 |
| GB | 2219504 | | 12/1989 |
| GB | 2223414 | | 4/1990 |
| GR | 3016707 | | 4/1996 |
| JP | 52-41392 | | 3/1977 |
| JP | 3258280 | | 1/2000 |
| JP | 5371152 | | 1/2011 |
| JP | 2913834 | | 4/2011 |
| NO | 310138 | | 12/1992 |
| PT | 2219504 | | 8/2010 |
| SU | 682238 | | 8/1979 |
| SU | 953075 | | 8/1982 |
| WO | PCT/US02/12250 | | 4/2002 |

* cited by examiner

METHOD AND APPARATUS FOR FASTENING OF INFLATABLE RIDE SURFACES

CROSS REFERENCE TO RELATED APPLICATIONS

This application claims the benefit of U.S. Provisional Patent Application Ser. No. 62/254,631, filed on Nov. 12, 2015, entitled "METHOD AND APPARATUS FOR FASTENING OF INFLATABLE RIDE SURFACES," which is hereby incorporated by reference in its entirety.

BACKGROUND

1. Field

The present invention relates generally to amusement attractions, such as surfing simulators or other wave machines. More particularly, the present invention relates to mobile surfing attractions that incorporate one or more sections, such as ride sections or surfaces, for connection with one another to form a larger section or surface.

2. Description of the Related Art

Water attractions (e.g., waterslides, surfing slides or machines, boogie-boarding slides, etc.) are a popular entertainment activity during periods of warm weather. Conventional water attractions have been commonly made of fiberglass or other rigid or semi-rigid materials that provide a smooth and slippery surface for supporting a flow of water thereon to transport a rider from an entrance to an exit. A variety of different types of ride vehicles (e.g., inner tubes, body boards, surf boards, floatation devices, etc.) have been used by the rider as the rider travels along the water attraction and may support the rider as the ride vehicle slides along the riding surface.

One type of water attraction that has proven a popular lure for patrons to water or other amusement parks or venues is the surfing machine or simulator. These machines may be used both for entertainment purposes as well as training purposes for helping instruct individuals that may be wary or otherwise unable to surf out in the open ocean. Conventional surf machines have utilized water pumps cooperating with one or more water delivery components (e.g., nozzles, sluices, jets, etc.) to flow a sheet or layer of water over a variety of surfaces and allow riders to skim atop the water flow. A riding surface of the conventional surf machine is typically a rigid or semi-rigid, low-friction surface that supports maneuvering by riders upon a conventional or modified surfboard or boogie board (individually and collectively referred to as a "board"). However, users without much surfing experience, either in the ocean or upon surfing machines, commonly fall off of the board during initial attempts at using the surfing machine and the surfaces of these apparatuses can make uncomfortable contact with a rider upon the rider's falling off of their board.

Particularly at competition or sports venues (e.g., surfing competitions, BMX competitions, etc.) located outdoors, such as at or near the beach, surfing simulators have increasingly been in demand as a fun and revenue-generating activity for potential patrons. Surfing simulators also provide onlookers with an additional activity to engage in while present at the venue or event. Unfortunately, given the relatively short duration that many competitions extend, some lasting only a few days in duration, permanent installation of surfing simulators at those locations is not feasible. While some mobile surfing simulators have been developed, the comparably long and typically complex assembly and/or disassembly procedures, oftentimes taking greater time than the entire duration of the event itself, makes such devices undesirable to many potential event holders or organizers. These conventional simulators commonly utilize a large number of component parts that require vast numbers of shipment containers for their assembly, adding significantly to the cost associated with transporting and assembling the simulators at a desired geographic location.

As the sheet flow or standing wave product (collectively "surfing machine") market becomes more popular, water venues increasingly look to new surfing machines that can provide novel experiences to riders or that are less expensive or time consuming to install. Moreover, as the surfing industry becomes more sophisticated and the influence of extreme sports becomes more popular, more extreme standing waves created by such surfing machines are desired in order to satisfy the thrill anticipated by these new generation of users, both adults and children alike. However, issues of durability and wear-and-tear can be significant problems in systems made to be both comfortable for user's to land thereon and also to support fast-moving and/or pressurized flows of water. As such, improvements in manufacturing and/or connection of elements, such as ride surfaces or other sections of these rides, have increasingly become desired.

Moreover, as new surfing machines are developed, manoeuvrability, rider comfort, cost, and efficiency in assembly/disassembly should be adequately addressed and improvements to ensure cost effectiveness, particularly in the mobile water attraction market, is desired. Rider comfort and/or improvements to rider maneuverability would also be desired. Ideally, a surfing attraction would be inexpensive to construct and/or transport, quick and/or easy to assemble and/or disassemble, and would allow a rider to make contact with the surface of the water attraction, for example, upon falling off of a ride vehicle, with minimal discomfort. In an ideal surfing attraction, one or more component parts may be shipped as separate components and connected to form a larger riding surface while still maintaining a durable surface with improved wear-and-tear characteristics.

SUMMARY

A water attraction using inflatable materials is disclosed that is configured to be constructed of multiple segments or components for shipment or manufacture and are subsequently connected with one another to form a larger surface.

In one embodiment, a system for connecting a ride surface may include a first ride surface portion having an extrusion with a first mating surface disposed beneath a plane extending along a top surface of the first ride surface portion and a second ride surface portion having a receptacle with a second mating surface disposed beneath the plane extending along the top surface of the first ride surface portion, the receptacle configured to receive at least a portion of the extrusion. The first mating surface and the second mating surface may be configured to mate together when the extrusion is at least partially received by the receptacle for connecting the first ride surface portion with the second ride surface portion.

In another embodiment, a water ride may include a first attraction component having an extrusion with a first mating surface disposed beneath a plane extending along an exterior surface of the first attraction component, a second attraction component having a receptacle configured to receive the extrusion when the first attraction component is adjacent to the second attraction component, a nozzle for providing a flow of water over the first attraction component and the second attraction component, and a fastening mechanism extending over at least a portion of the first attraction component and the second attraction component for preventing the flow of water from making contact with the extrusion or the receptacle.

In still another embodiment, a system for a ride surface of a surfing attraction may include a ride surface material, a sheet configured to surround at least a portion of the ride surface material, a water delivery component for providing a flow of water onto the sheet, and a support configured to mate with the sheet, wherein the flow of water is configured to flow over the sheet without making contact with the ride surface material.

BRIEF DESCRIPTION OF THE DRAWINGS

Other systems, methods, features, and advantages of the present invention will be or will become apparent to one with skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale and may be exaggerated to better illustrate the important features of the present invention. In the drawings, like reference numerals designate like parts throughout the different views, wherein:

DETAILED DESCRIPTION

The detailed description of exemplary embodiments herein makes reference to the accompanying drawings and pictures, which show the exemplary embodiments by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Figure 1:
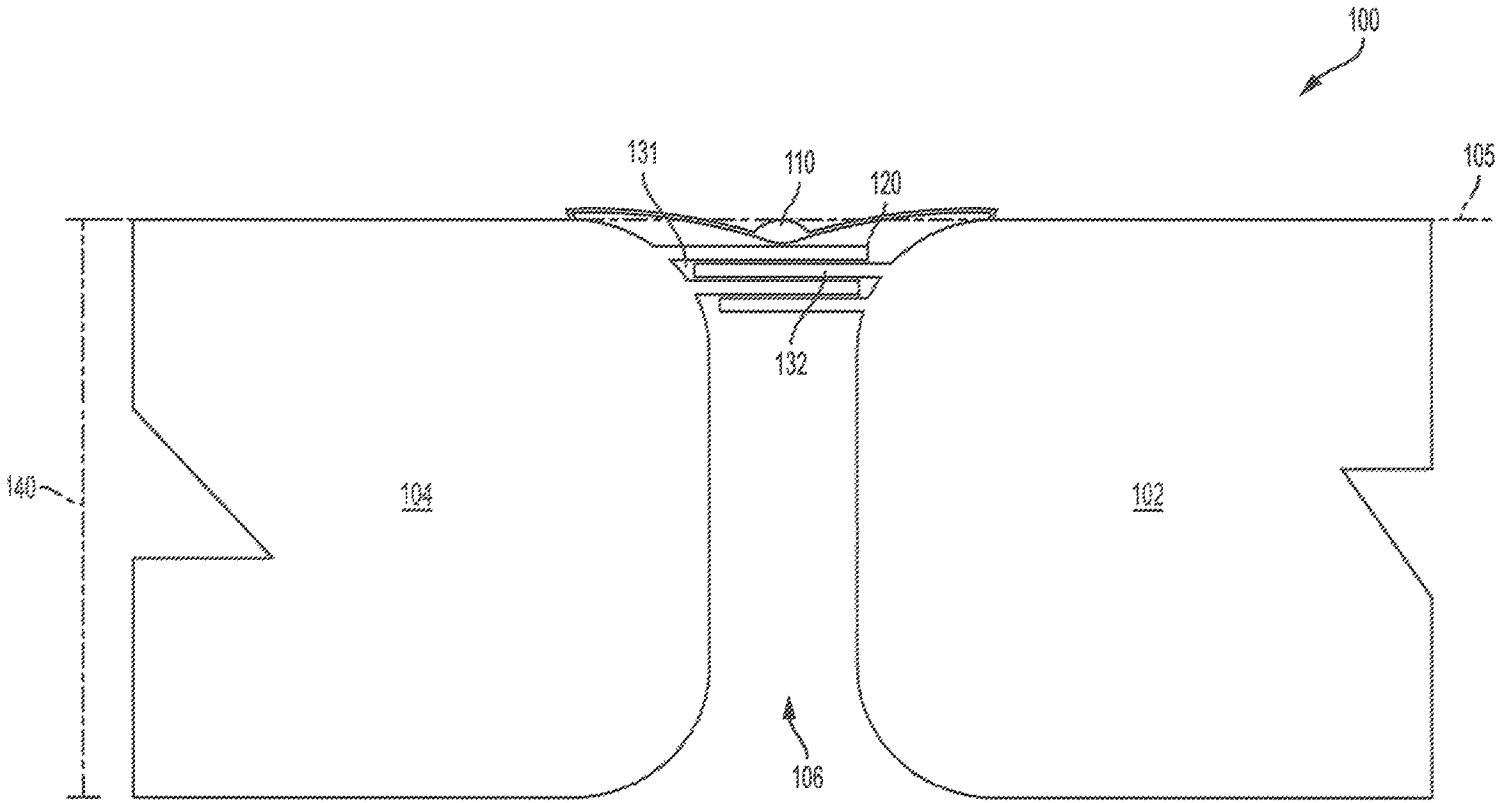
FIG. 1 shows a cross-sectional side view of a ride surface of a surfing or other water or fluid attraction made up of a plurality of components according to one embodiment of the present invention.

FIG. 1 shows a cross-sectional side view of a ride surface 100 of a surfing or other water or fluid attraction. The ride surface 100 may be made up of a plurality of components. Although the below description focuses upon the ride surface 100 of an attraction for the purposes of illustration, other sections and/or surfaces of an attraction or other device (e.g., entertainment structure) may use one or more of the novel concepts discussed herein in alternative embodiments.

In one embodiment, the ride surface 100 may be a surface configured to have a flow of fluid (e.g., a sheet-flow of water) disposed thereon such that one or more riders may perform water skimming or surfing maneuvers upon the ride surface 100 and/or upon the flow of water. The ride surface may be fully or partially inflatable (e.g., made of a drop-stitch or other inflatable material) that may provide for additional comfort for a rider in the event that the rider loses balance and falls upon the ride surface 100. An alternative embodiment may be any form of surface that would benefit from a secure connection of one or more components while providing increased durability or resistance to wear-and-tear, particularly from a flow of fluid that may be disposed thereon during operation. For example, padding and/or foam materials, whether or not inflatable, may benefit from the secure connection of surfaces as described herein in alternative embodiments.

As illustrated, during manufacture and/or shipment, the ride surface 100 may initially be made up of a plurality of discrete components, for example, a first ride surface portion 102 and a second ride surface portion 104. During setup or installation of a water attraction, such as the previously-mentioned surfing attraction, the first ride surface portion 102 may be positioned near and/or adjacent to the second ride surface portion 104. Such installation may be performed on-site at the location where the attraction is intended to be used or at any of a variety of alternative locations (e.g., a manufacturing or installation location and subsequently transported to the location where the attraction is intended to be used). Once two or more portions are connected together, as discussed in greater detail herein, a substantially contiguous and larger ride surface 100 may be made up of both the first ride surface portion 102 and the second ride surface portion 104.

However, absent special manufacturing techniques (e.g., melting or otherwise mixing of the two components), there exists a small gap 106 between the first ride surface portion 102 and the second ride surface portion 104. It may be desirable to limit the effect of any such gap in order to create the ride surface 100 with as smooth and/or continuous of an upper surface as possible (e.g., so that water flowing over a top surface of the first ride surface portion 102 and/or water flowing over a top surface of the second ride surface portion 104 does not undesirably become turbulent at the mating edge or junction of the first ride surface portion 102 and the second ride surface portion 104).

Moreover, due to the flow of water or other fluid thereover, fasteners that are disposed along the top surfaces of the first and second ride surface portion (102, 104) may encounter disruptive forces due to such fluid that begins compromising their ability to successfully mate the first and second ride surface portions (102, 104) together. To combat this durability concern and/or other issues mentioned above, the first ride surface portion 102 includes a fastening element that is disposed beneath a plane 105 that extends along a surface (e.g., a top surface) of the first ride surface 102. Similarly, the second ride surface portion 104 includes a fastening element that is disposed beneath the plane 105 that extends along a surface (e.g., a top surface) of the second ride surface portion 104. For example, either or both of the first and second ride surface portions (102, 104) may be manufactured with a "cut-out" (e.g., receptacle or cut-out 131) and/or a corresponding extrusion (e.g., extrusion 132) at a level beneath the plane 105, for example, that comprises a part of their perimeter or top surfaces. Any of a variety of cut-outs and corresponding extrusions may be used in varying embodiments.

The above connection between the first ride surface portion 102 and the second ride surface portion 104 allows for one or more matings 120 at the gap 106 of the first and second ride surface portions (102, 104) beneath the plane 105 that extends across the top surface of the ride surface 100. In certain embodiments, the mating 120 may also or alternatively occur at the plane 105 (e.g., flush with the plane 105). Thus, using the matings 120 described above, water or other fluid flowing over the top surface of the ride surface 100 will be less inclined to exert a disruptive force upon the mating 120 of the first and second ride surface portions (102, 104). In one embodiment, the mating 120 may be performed by way of Velcro or other loop-and-pin closure fastening elements. In another embodiment, any of a variety of possible fastening elements disposed below an upper or top surface of the ride surface 100 may be used (e.g., adhesives, brackets, screws, bolts, etc.) such that a secure connection is made beneath the plane 105.

In certain embodiments, as illustrated, an additional fastening mechanism 110 may be provided over the gap 106 (or otherwise in alternative embodiments) to aid in reducing an amount of fluid or water that may seep into the gap 106 and exert a disruptive force upon the mating 120 of the first and second ride surface portions (102, 104). For example, the additional fastening mechanism 110 may have all or a portion of its structure positioned beneath the plane 105, flush with the plane 105, and/or above the plane 105. In one embodiment, the additional fastening mechanism 110 may be a ripper. In an alternative embodiment, the additional fastening mechanism 110 may be any of a variety of possible closure or fluid prevention elements. In still another alternative embodiment, no additional fastening mechanism 110 may be desired.

The plurality of cut-outs 131 and/or extrusions 132 may extend any of a variety of distances or percentages of the total thickness 140 of the ride surface portions (102, 104). For example, although two extrusions 132 are used in the embodiment shown in FIG. 1, additional or fewer extrusions 132 may be used in an alternative embodiment. Likewise, the number of cut-outs 131 may be the same or different than the number of extrusions 132 in alternative embodiments. Greater number of extrusions 132 may extend further along the total thickness 140 of the ride surface portions (102, 104). Greater numbers of extrusions 132 and/or cut-outs 131 that extend further along the total thickness 140 may provide stronger connection capabilities, but at greater material or manufacturing cost.

Figure 2:
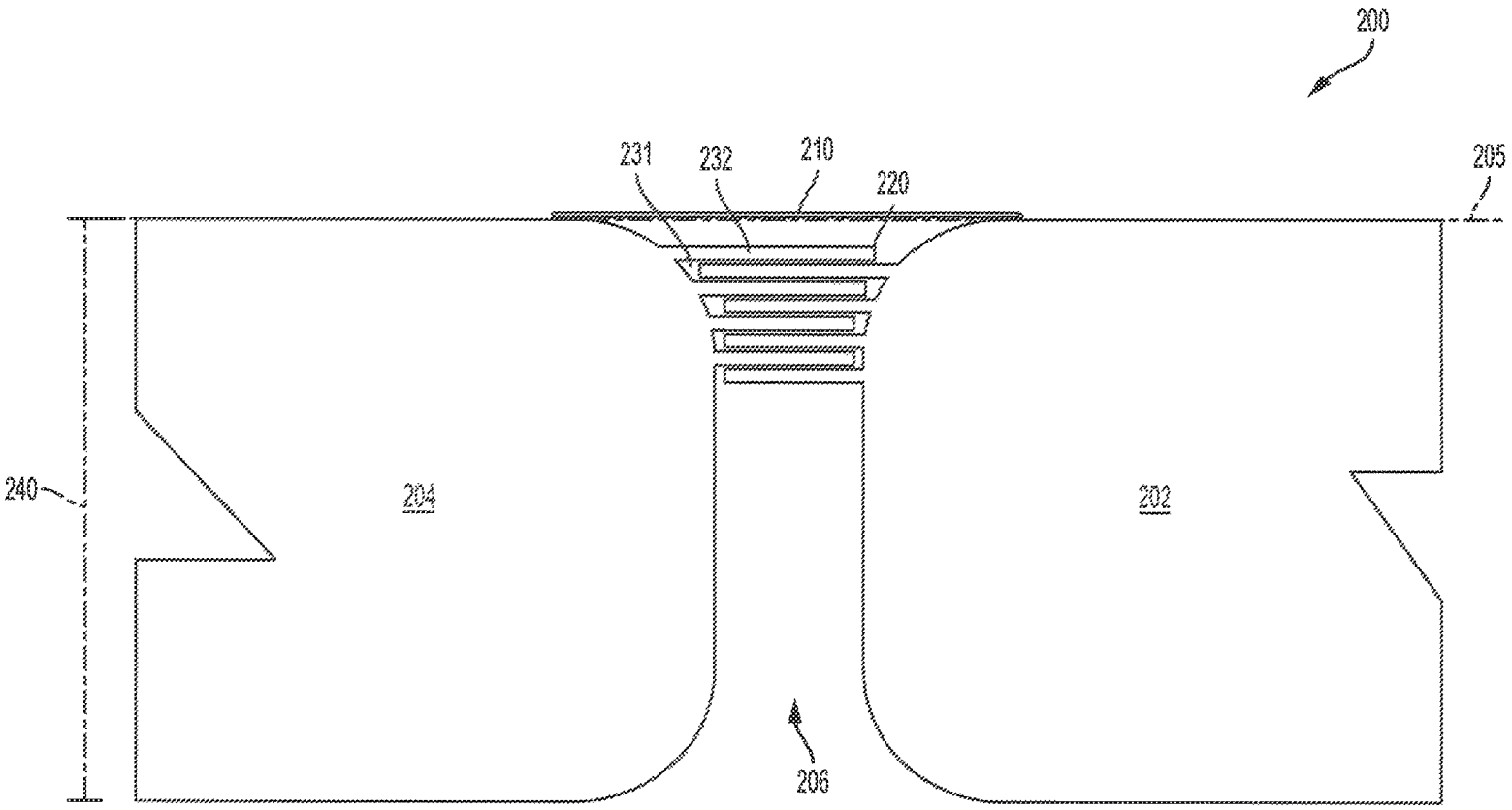
FIG. 2 shows a cross-sectional side view of a ride surface of a surfing or other water or fluid attraction made up of a plurality of components according to one embodiment of the present invention.

FIG. 2 similarly shows a cross-section of one embodiment of a ride surface 200 that is constructed of a plurality of components. The ride surface 200 may include features that are the same as or similar to those previously discussed. For example, in one embodiment, the ride surface 200 may be a surface configured to have a flow of water disposed thereon (e.g., above a plane 205) such that one or more riders may perform water skimming or surfing maneuvers upon the ride surface 200 and/or the flow of water. The ride surface may be fully or partially inflatable (e.g., made of a drop-stitch or other inflatable material) that may provide for additional comfort for a rider in the event that the rider loses balance and falls upon the ride surface 200. An alternative embodiment may be any form of surface that would benefit from a secure connection of one or more components while providing increased durability or resistance to wear-and-tear, particularly from a flow of fluid that may be disposed thereon during operation.

As illustrated and similar to previous discussions, during manufacture and/or shipment, the ride surface 200 may initially be made up of a plurality of discrete components, for example, a first ride surface portion 202 and a second ride surface portion 204. During setup or installation of a water attraction, such as the previously mentioned surfing attraction, the first ride surface portion 202 may be positioned near and/or adjacent to the second ride surface portion 204 in order to construct, once complete, a substantially contiguous and larger ride surface 200 made up of both the first ride surface portion 202 and the second ride surface portion 204. A gap 206 may be present between the first ride surface portion 202 and the second ride surface portion 204 as previously discussed.

Similar to features described in FIG. 1, the first ride surface portion 202 includes one or more fastening elements that are disposed beneath the plane 205. For example, either or both of the first and second ride surface portions (202, 204) may be manufactured with a "cut-out" (e.g., cut-out 231) and/or a corresponding extrusion (e.g., extrusion 232) at a level beneath the plane 205, for example, that comprises a part of their perimeter or top surfaces. Any of a variety of cut-outs and corresponding extrusions may be used in varying embodiments. The embodiment illustrated in FIG. 2 utilizes a greater number of cut-outs 231 and extrusions 232 than were previously described for FIG. 1 and/or extend further along a total thickness 240 of the first ride surface portion 202 and/or the second ride surface portion 204. The cut-outs 231 and/or extrusions 232 may be any of a variety of desired lengths, widths, and/or thicknesses (e.g., they may all be the same length, width, and/or thickness and/or may be different lengths, widths, and/or thicknesses when compared with one another).

In certain embodiments, as illustrated, an additional fastening mechanism 210 may be provided over the gap 206 (or otherwise in alternative embodiments) to aid in reducing an amount of fluid or water that may seep into the gap 206 and exert a disruptive force upon the mating 220 of the first and second ride surface portions (202, 204). In one embodiment, the additional fastening mechanism 210 may be a flap (e.g., inflatable or otherwise) that is configured to extend from either the first ride surface portion 202 and/or the second ride surface portion 204 and cover all or a portion of the gap 206. Extra fastening elements may or may not be utilized in conjunction with the flap (e.g., zippers, adhesives, snaps, buttons, etc.). The additional fastening mechanism 210 (e.g., flap as shown) may be configured to lay in a direction substantially parallel with the expected flow of water (e.g., may be shaped and/or connected with one or more components of the ride surface 200 such that it is urged in its naturally laying direction when presented with the flow of water during operation. Such a configuration may help in reducing wear and tear to the additional fastening mechanism 210 (e.g., because it is being urged in its natural direction via the water flow) and/or the underlying mating 220 within the gap 206.

In other embodiments, the additional fastening mechanism 210 may be configured to lay in alternative directions and/or may be shaped or configured to lay flush with adjacent fastening mechanisms and/or parts corresponding to other ride surface portions. In an alternative embodiment, the additional fastening mechanism 210 may be any of a variety of possible closure or fluid prevention elements. In still another alternative embodiment, no additional fastening mechanism 210 may be desired.

Figure 3:
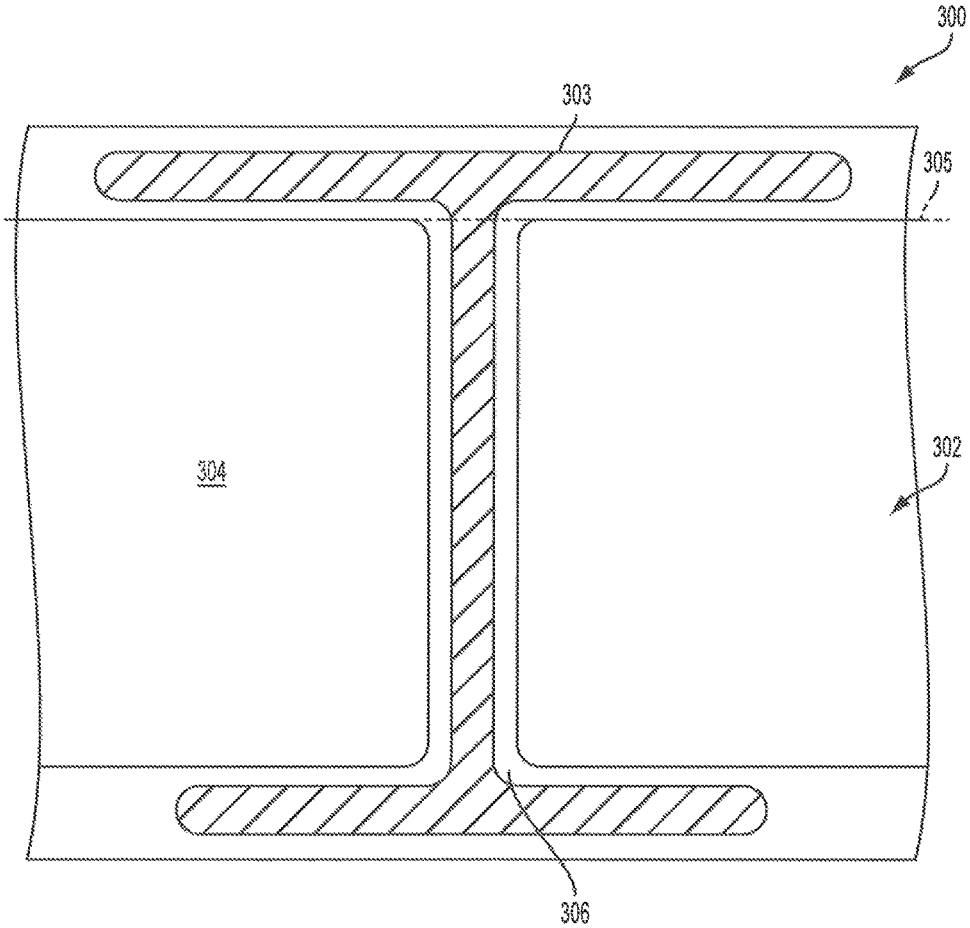
FIG. 3 shows a cross-section side view of a ride surface of a surfing or other water or fluid attraction made up of a plurality of components according to one embodiment of the present invention.

FIG. 3 shows a cross-sectional side view of a ride surface 300 of a surfing or other water or fluid attraction made up of a plurality of components. The ride surface 300 may include features that are the same as or similar to those previously discussed. As illustrated, during manufacture and/or shipment, the ride surface 300 may initially be made up of a plurality of discrete components, for example, a first ride surface portion 302 and a second ride surface portion 304. During setup or installation of a water attraction, such as the previously mentioned surfing attraction, the first ride surface portion 302 may be positioned near and/or adjacent to the second ride surface portion 304 in order to construct, once complete, a substantially contiguous and larger ride surface 300. However, absent special manufacturing techniques (e.g., melting or otherwise mixing of the two components), there exists a gap 306 between the first ride surface portion 302 and the second ride surface portion 304.

In one embodiment, the gap 306 may be filled with custom extrusion material 303. In certain embodiments, this extrusion material 303 may be made of flexible PVC, nylon, and/or any of a variety of other materials. The extrusion material 303 may be in the shape of an "I." In some embodiments, the extrusion material 303 may be low in profile and/or all or some of the extrusion material 303 may be flush with and/or below a plane 305 ride surface portions (302, 304). In such embodiments, the extrusion material 303 may not interfere or may minimally interfere with rideability of the ride surface 300. The extrusion material 303 may be heavy in density and/or otherwise designed not to allow water penetrating into the gap 306, for example, by being shaped and/or configured to match the shape and/or configuration of the underlying gap 306.

The extrusion material 303 may be fastened with either the first ride surface portion 302 and/or the second ride surface portion 304 via a variety of possible connections. For example, the extrusion material 303 may be held in place via adhesives, screws, bolts, Velcro, etc. In another example, the first ride surface portion 302 and/or the second ride surface portion 304 may hold the extrusion material 303 in place without additional material or component connections (e.g., the shape of the extrusion material 303 may cooperate or interface, such as via friction, with a shape of the first ride surface portion 302 and/or the second ride surface portion 304 to retrain in place. Fastening of the extrusion material 303 with one or more of the first ride surface portion 302 and/or the second ride surface portion 304 may occur at any of below the plane 305, above the plane 305, and/or at the plane 305. Similar to previously discussions, additional fastening mechanisms (e.g., zippers, flaps, etc.) may additionally be used in an embodiment that uses the extrusion material 303.

Figure 4:
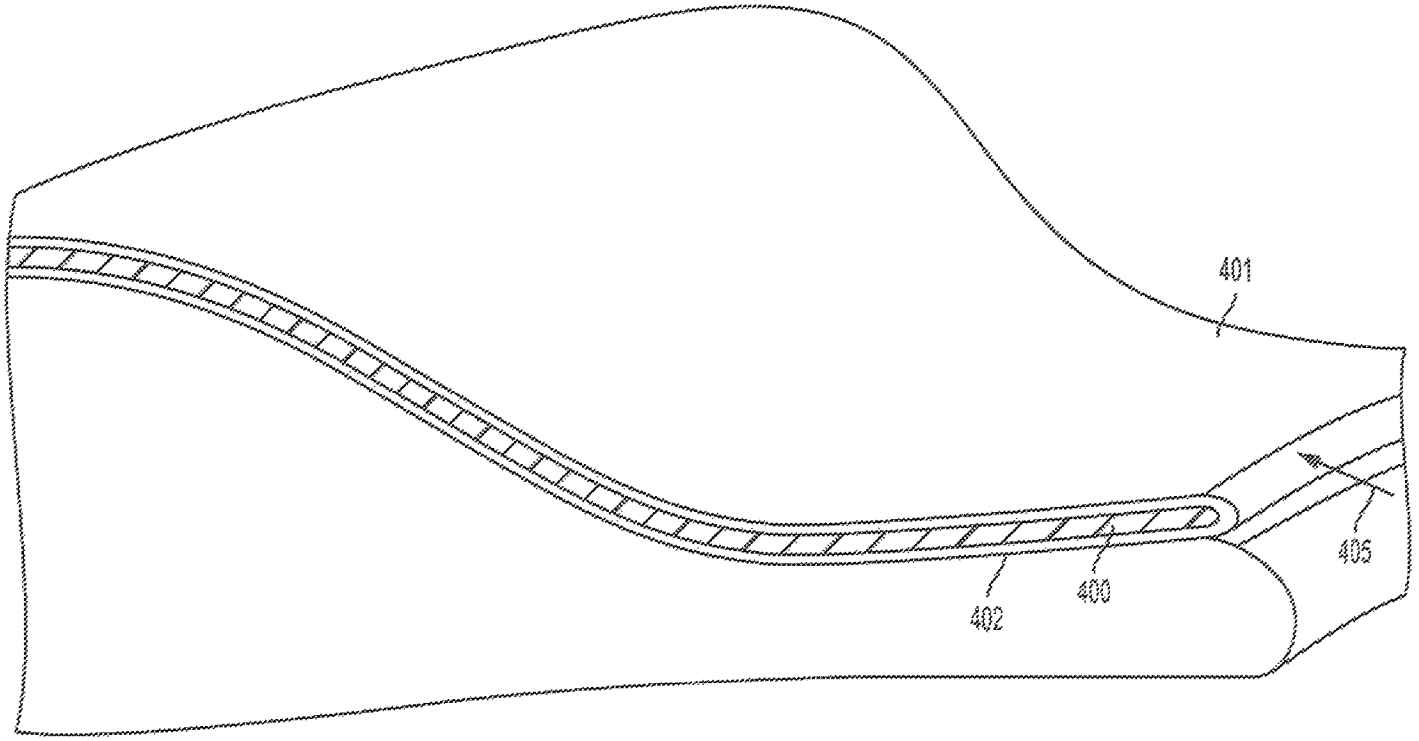
FIG. 4 is a perspective view of a ride surface of a surfing or other water or fluid attraction made up of a plurality of components according to one embodiment of the present invention.
Figure 5:
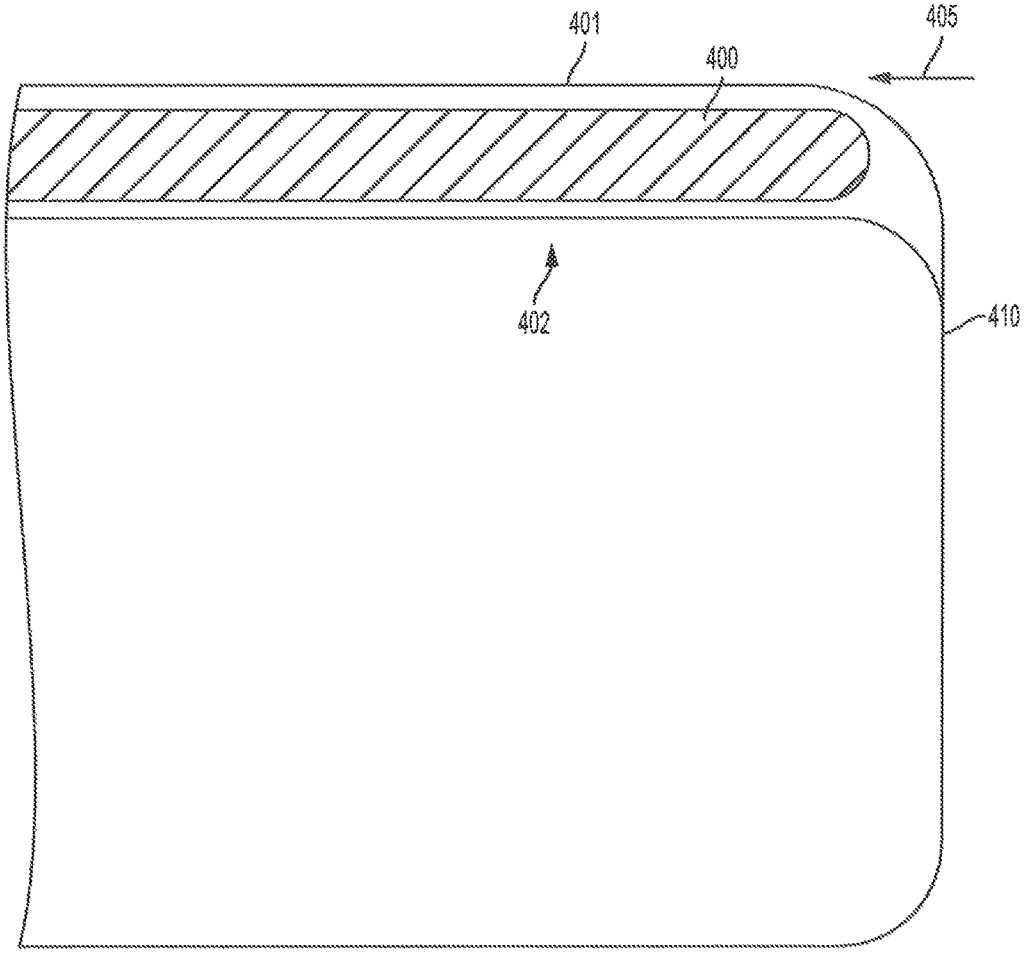
FIG. 5 is a partial cross-section side view of FIG. 4.

FIGS. 4 and 5 refer to another embodiment of the present invention. FIGS. 4 and 5 illustrate a ride surface 400 being pocketed or otherwise partially or fully contained in a sheet 401. In one embodiment, the sheet 401 which may be made of vinyl. In alternative embodiments, other materials for the sheet 401 may be used. The ride surface 400 may sit on top of a support or other surface 402. The sheet 401 may fasten to any of a variety of substructure pieces (e.g., each substructure piece), including the support or other surface 402, by means of a chemical bond (e.g., glue, heat weld), or mechanical fastening (e.g., hook and/or loop), or both. In an alternative embodiment, other fastening manners and/or components may be used.

As illustrated in FIG. 4, the ride surface 400 may be contained within the sheet 401 such that the sheet 401 may be removable and/or replaceable. In this fashion, as the sheet 401 reaches the end of its useful life (e.g., for durability and/or war-and-tear purposes), the sheet 401 may be replaced without having to replace the underlying ride surface 400. The sheet 401 may be made of a different material than the ride surface 400. Moreover, the sheet 401 and/or the ride surface 400 may be made of a different material than the support or other surface 402.

FIG. 5 illustrates a cross-section side view of FIG. 4 and shows the connection of the sheet 401 with the support or other surface 402. Water or other fluid may flow 405 from one end and encounter a rolled or otherwise curved portion of the sheet 401. The sheet 401 may be connected with the support or other surface 402 at a location (e.g., beneath) where the flow 405 is otherwise delivered to the sheet 401 in order to reduce the impact the flow 405 may have upon the connection seam or point 410. In certain embodiments, this may help increase the durability of an attraction utilizing the features illustrated since a fluid flow may significantly impact the durability of connection seams where two separate materials meet or are connected. For example, in the embodiment shown, the sheet 401 may mate with the support or other surface 402 along a vertical surface or portion of the support or other surface 402. In another embodiment, the connection of the sheet 401 with the support or other surface 402 may be at any of a variety of desired locations and/or using a variety of possible connection mechanisms.

The previous description of the disclosed examples is provided to enable any person of ordinary skill in the art to make or use the disclosed methods and apparatus. Accordingly, the terminology employed throughout should be read in a non-limiting manner. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope. Skilled artisans may implement the described functionality in varying ways for each particular application, but such, implementation decisions should not be interpreted as causing a departure from the scope of the disclosed apparatus and methods. The steps of the method or algorithm may also be performed in an alternate order from those provided in the examples.

What is claimed is:

1. A system for connecting surfaces, comprising:

a first surface portion having an extrusion with a first mating surface disposed beneath a plane extending along a top surface of the first surface portion;

a second surface portion having a receptacle with a second mating surface disposed beneath the plane extending along the top surface of the first surface portion, the receptacle configured to receive at least a portion of the extrusion, the first mating surface and the second mating surface configured to mate together, defining a gap therebetween, when the extrusion is at least partially received by the receptacle for connecting the first surface portion with the second surface portion; and a flap configured to extend over the gap above the plane, and over at least a part of the first surface portion or the second surface portion, when the first mating surface is mated with the second mating surface, such that the flap is urged to lay against the first and second portions during operation when presented with a flow of water.

2. The system of claim 1 wherein the first mating surface or the second mating surface is Velcro.

3. The system of claim 1 wherein the first surface portion or the second surface portion is made of a drop-stitch material.

4. The system of claim 1 wherein the flap is configured to mate with the first surface portion and the second surface portion.

5. The system of claim 4 wherein the flap is configured to mate with the first surface portion or the second surface portion via a zipper.

6. The system of claim 4 wherein the flap is configured to mate with the first surface portion or the second surface portion via a loop-and-pin closure.

7. The system of claim 4 wherein the flap is configured to mate with the first surface portion or the second surface portion via an adhesive.

8. The system of claim 1 wherein the flap includes:

a first flap portion connected with the first surface portion and having a first fastening element; and a second flap portion connected with the second surface portion and having a second fastening element, wherein the first fastening element is configured to fasten with the second fastening element if the first mating surface is mated with the second mating surface.

9. The system of claim 8 wherein the first fastening element or the second fastening element is a zipper.

10. The system of claim 8 wherein the first fastening element or the second fastening element is a loop-and-pin closure.

11. A water ride comprising:

a first attraction component having an extrusion with a first mating surface disposed beneath a plane extending along an exterior surface of the first attraction component;

a second attraction component having a receptacle configured to receive the extrusion when the first attraction component is adjacent to the second attraction component defining a gap therebetween;

a nozzle for providing a flow of water over the first attraction component and the second attraction component; and a fastening mechanism extending over the gap above the plane and at least a portion of the first attraction component and the second attraction component, such that the fastening mechanism is urged to lay against the first and second attraction components during operation when presented with a flow of water.

12. The water ride of claim 11 wherein the first mating surface and the second mating surface are configured to mate together when the extrusion is at least partially received by the receptacle for connecting a first ride surface portion of the first attraction component with a second ride surface portion of the second attraction component.

13. The water ride of claim 11 wherein the first mating surface and the second mating surface are configured to mate together when the extrusion is at least partially received by the receptacle for connecting a first ride surface portion of the first attraction component with a second ride surface portion of the second attraction component.

14. The water ride of claim 11 wherein the first attraction component and the second attraction component form at least a part of a ride surface for performing surfing tricks thereon.

15. The system of claim 11 wherein the first mating surface or the second mating surface mate together via pin-and-loop closure.

16. A system for a ride surface of a surfing attraction comprising:

a ride surface material;

a sheet having a pocket and configured to at least partially contain the ride surface material within the pocket of the sheet:

a water delivery component for providing a flow of water onto the sheet; and a support configured to mate with the sheet to form a ride surface portion, wherein the flow of water is configured to flow over the sheet without making contact with the ride surface material.

17. The system of claim 16 wherein the sheet is configured to be removable from the ride surface material for replacement of the sheet.

18. The system of claim 16 wherein the sheet is mated with the support at a substantially vertical orientation.

* * * * *